US007703760B2

(12) United States Patent
Honegger

(10) Patent No.: US 7,703,760 B2
(45) Date of Patent: Apr. 27, 2010

(54) METHOD AND A DEVICE FOR PROCESSING AND SEPARATING AN IMBRICATE FORMATION OF FLEXIBLE, FLAT OBJECTS

(75) Inventor: Werner Honegger, Bäch (CH)

(73) Assignee: Ferag AG, Zurichstrasse, Hinwill (CH)

( * ) Notice: Subject to any disclaimer, the term of this patent is extended or adjusted under 35 U.S.C. 154(b) by 958 days.

(21) Appl. No.: 10/660,783

(22) Filed: Sep. 12, 2003

(65) Prior Publication Data

US 2004/0084830 A1 May 6, 2004

(30) Foreign Application Priority Data

Sep. 12, 2002 (CH) ..... 1554/02

(51) Int. Cl.
*B65H 5/00* (2006.01)

(52) U.S. Cl. ..... 271/10.01

(58) Field of Classification Search ..... 271/149, 271/150, 151, 10.01, 10.09, 182
See application file for complete search history.

(56) References Cited

U.S. PATENT DOCUMENTS

| | | | | |
|---|---|---|---|---|
| 3,334,890 | A * | 8/1967 | La Bombard et al. | 271/4.09 |
| 3,881,718 | A | 5/1975 | Fernandez-Rana et al. | |
| 4,180,259 | A | 12/1979 | Bewersdorf et al. | |
| 4,201,286 | A | 5/1980 | Meier | |
| 5,100,022 | A * | 3/1992 | Fukudome et al. | 221/198 |
| 5,131,899 | A * | 7/1992 | Nagahashi et al. | 493/317 |
| 5,308,052 | A * | 5/1994 | Roch et al. | 271/2 |
| 5,636,832 | A | 6/1997 | Honegger et al. | |
| 5,934,666 | A * | 8/1999 | Rabindran et al. | 271/148 |

FOREIGN PATENT DOCUMENTS

| | | | |
|---|---|---|---|
| CH | 324210 | | 9/1957 |
| CH | 391743 | | 12/1991 |
| DE | 2531262 | A1 | 1/1977 |
| DE | 19627830 | A1 | 2/1997 |
| EP | 0755886 | B1 | 1/1997 |
| EP | 0675061 | B1 | 12/1997 |
| EP | 0863099 | B1 | 9/1998 |
| EP | 1055620 | A1 | 11/2000 |
| EP | 1057763 | A2 | 12/2000 |
| EP | 1086914 | B1 | 3/2001 |
| EP | 1096914 | B1 | 5/2001 |
| GB | 1 578 250 | | 11/1980 |
| GB | 2178409 | * | 2/1987 |
| WO | WO 00/46132 | | 8/2000 |
| WO | WO 00/46135 | | 8/2000 |

* cited by examiner

*Primary Examiner*—Patrick H Mackey
*Assistant Examiner*—Thomas A Morrison
(74) *Attorney, Agent, or Firm*—Robert E. Bushnell, Esq.

(57) ABSTRACT

The invention relates to a method and to a device for processing and separating an imbricate formation of flexible, flat objects 10, in particular of folded printed products. The imbricate formation is influenced by way of a guide means 1 which at least in regions is inclined with respect to the horizontal such that the objects are differently inclined with respect to the vertical. The guide means 1 serve for reforming the flat objects of the imbricate flow in angle and alignment, wherein at its end there is effected a removal of individual or groups of flat objects. At the end of a guide surface 2 of the guide means 1 there is arranged a conveyor means 9 which serves for conveying away the isolated objects 10.

8 Claims, 3 Drawing Sheets

METHOD AND A DEVICE FOR PROCESSING AND SEPARATING AN IMBRICATE FORMATION OF FLEXIBLE, FLAT OBJECTS

CLAIM OF PRIORITY

This application makes reference to, incorporates the same herein, and claims all benefits accruing under 35 U.S.C. §119 from my application A METHOD AND A DEVICE FOR PROCESSING AND SEPARATING AN IMBRICATE FORMATION OF FLEXIBLE, FLAT OBJECTS filed with the Swiss Federal Institute of Intellectual Property on Sep. 12, 2002 and there duly assigned Ser. No. 2002 1554/02.

BACKGROUND OF THE INVENTION

1. Technical Field

The invention relates to a method and to a device for processing and separating an imbricate formation of flexible, flat and flexible objects, in particular, printed products.

2. Prior Art

From the state of the art there are known various feeders and devices, specifically in order to isolate printed products or to grasp these individually and to transfer these products for further transport to a conveyor. The disadvantages of the state of the art are due to the counter-running movement pattern, the large inertia and friction forces and the abrupt directional change. With the machines used today the operations are not flowing, but have a static component. This means that a printed product to be processed is brought completely to a standstill in order to be then accelerated abruptly in another direction. This has a negative effect, particularly at high processing speeds.

From CH 324210 by Müller, entitled *Anlegemasehine für die Pavier industrie*, and published on 15 Sep. 1957, there is known, for example, a feeder machine for the paper industry. This serves for feeding folded printed sheets onto saddles of a feeder transport belt of a binding machine. The device is based on a drum which is arranged between a stack of folded printed sheets supported on an oblique plane and a transport belt with saddles. The printed sheets are arranged standing on their folds in the feed region. The drum which is arranged essentially tangentially to the frontmost printed sheet on its periphery, comprises a gripper by way of which the respective frontmost printed sheet of the ply is gripped and pulled off at the cut-edge side. Pulling-off the next printed sheet is only possible if the previous sheet has been completely removed from the stack. Each printed sheet is deflected and borne on the drum, and thrown off onto a saddle of the feed transport belt. With this device, in each case only one printed sheet is processed per operating cycle; this results in a limitation on the processing speed due to the basic operating principle. So that the printed sheet may be grasped, it is furthermore necessary for the drum of the gripper to carry out a counter-directed movement. With fast-running machines, this leads to high inertia forces. Due to the functioning principle on which it is based, this device is not suitable for processing large volumes, and furthermore, the separation at the cut-edge side is burdened with problems.

DE 2531262 by Güither Schick, entitled *Hochleistungsanleger für Loseblatt oder gefalzte Lagen aus Papier oder ähntich biegsamen Werkstoffen* and published on 25 Jan. 1977, shows a feeder for sheets or folded layers of paper or similarly flexible materials. Printed sheets, in the form of an imbricate flow (leading edge at the top) are moved along an oblique plane by way of a conveyor belt. The printed sheets on a further oblique plane are piled up into an obliquely set position and brought to a standstill. The respective lowermost printed sheet of the oblique ply is grasped by way of a wheel equipped with grippers and deflected by way of a deflection roller. By way of this, the printed sheets are pulled from the obliquely set position. In contrast to the device known from Hans Müller in CH 324210, the printed sheets are not pulled off individually, but are pulled of in the form of a continuous, imbricate flow. Due to the large deflection during the step of pulling-off, the printed sheets are excessively loaded. For isolating the printed sheets, a suggestion has been made to arrange an acceleration path after this.

EP 1055620 by Keller et al., and published on 29 Nov. 2000, of the same applicant shows a device for accommodating and for the further transport of flat, printed products. A multitude of grippers with associated suction members are attached along a revolving wheel. The printed sheets to be processed are arranged on a stack from which they are lifted by way of the suction members and brought into the active region of the grippers. The printed sheets are gripped by the grippers and subsequently deposited in the form of an imbricate flow and conveyed away by a conveyor. This device permits the gripping of printed sheets within very short distances, wherein the suction heads and products are aligned with one another.

EP 1086914 entitled *DEVICE FOR TRANSPORTING FLEXIBLE AND FLAT PRODUCTS*, by Egon Hänsch, published on 28 Mar. 2001, shows a device for the transport of flat products from a stationary stack positioned in a receiving location to a dispensing location. The device comprises a separating member, as well as a support element and a holding member which are arranged running around a shaft. The products are gripped individually, separated and transferred to a device that serves as an exit conveyance. With this device the products are also mechanically loaded.

WO 00/46135 entitled *DEVICE FOR UNSTACKING A PILE OF FLAT OBJECTS, ESPECIALLY PRINTING PRODUCTS*, by Willy Leu. published on 10 Aug. 2000, shows a device for reducing a stack of flat objects, in particular, printer's products. By way of a lift, the respective uppermost printed sheet is lifted from a stack and brought into the active region of a conveyor belt which serves for leading away the printed sheets in the form of an imbricate flow. The device is designed such that it is adaptable to the height of the stack. Although it is simplified in comparison to the state of the art, the device requires a control.

EP 0863099 entitled *DEVICE FOR SEPARATING PILED PRINTED PRODUCTS*, by Alex Keller, published on 9 Sep. 1998, shows a device for isolating stacked printer's products. The printed sheets to be processed are inserted below a stack by way of conveyor. From this stack the respective uppermost printed product is gasped by a gripper and led away individually. So that the printed sheets may be gasped, they are individually lifted by way of a lifting mechanism and brought into the active region of the gripper.

EP 0755886 entitled *DEVICE FOR FEEDING PRINTED PRODUCTS TO A FURTHER WORK STATION*, by Alex Keller, published on 29 Jan. 1997, shows a device for feeding folded printers' products to a location for further processing. Printed sheets supplied in an imbricate flow are led to a stacking location by way of a conveyor, where they are inserted below an intermediate stack. By way of a lifting member (e.g., a suction member) moved along a circumferential path, the respective uppermost printer's product is lifted at the fold's edge and brought into the active region of a conveyance. The conveyance uses a segmented roller and a circumferential belt which serves for pressing the printed products onto the segmented roller. The printed sheets are lifted one after the other and brought into the active region of the conveyance by which they are grasped and led away in the form of an imbricate flow.

DE 19627830 by Jürg Eberie, published on 6 Feb. 1997, shows a device for feeding printed products to a conveyance. A suction member arranged on the inside of a rotor engages through a recess when grasping a printers' product and draws a corner region into the interior of the rotor. The printers' product is then engaged at the bottom by a rotor arm and lifted farther in order to bring it into the active region of a conveyor. The printed products are conveyed away, either individually or in the form of an imbricate flow, by way of grippers.

EP 0675061 entitled *"DEVICE FOR CONTINUOUSLY FEEDING FLAT ARTICLES TO A DELIVERY POINT"*, by Honegger et al., published on the 10th of Dec. 1997, shows a device for an uninterrupted supply of flat products to a dispensing location. The printers' products are led to the dispensing location by way of an endless conveyor belt. At the dispensing location the conveyor belt, at least in regions, is guided around a deflection roller and extends around the deflection wheel in an undershooting manner. The conveyor belt driven by a stepper motor and a deflection wheel form a conveying gap for the products to be processed which are arranged in an imbricate formation. The respective uppermost product of a partial stack is grasped by way of a suction head and lifted.

As may be deduced from the above-described documents, the devices known from the state of the art for separating printers' products have a relatively complicated construction, wherein the complexity is partly due to the control. Depending on the mentioned principles, the processing speed is furthermore limited so that the printed products are not excessively loaded and the processing steps are effected in a reliable manner. Most known devices are based on the fact that printed products that require further processing need to be brought completely to a standstill so that they may be grasped by a gripper or equivalent device. Inasmuch as fluent processing is desired, in the state of the art expensive designs, special controls, are required in order to be able to separate the printed products with high accuracy. A further disadvantage of conventional designs for continuous processing, i.e., if the printed product is not to be brought completely to a standstill, lies in the fact that (a limited) buffering with but short-term malfunctioning may be accommodated, in indeed if at all, by complicated sensors with control and regulation installations. For this reason as well as others, most devices envisage a "static" intermediate stack from which the printed products (that have previously been braked to a standstill or almost to a standstill) are accelerated, pulled off and isolated.

SUMMARY OF THE INVENTION

The object of the invention lies in providing a method and a device for the continuous processing of an imbricate formation of flexible flat objects, specifically printed products, in particular, and for the exact separation and transfer of individual printed products from this imbricate formation to a conveying member, which demands a comparatively low design, control and regulation expense relative to the technology.

This object is achieved by the invention defined in the independent patent claims.

The invention is based on a flowing transformation of an imbricate formation of flexible, flat objects, in particular, folded printed sheets, by way of a guide. In the following detailed description, reference is made only to printed products, wherein other flat objects may of course also be included in the practice of the principles of the present invention.

The printed products to be processed are preferably supplied in the form of an imbricate flow with trailing edges, and with the fold of the folded sheets of the printed products or printed sheets arranged at the top and subsequently the printed products overlap. Such an imbricate flow is fed to the guide that serves to reformate the imbricate flow in angle, alignment and density to produce a new imbricate formation. Independently of whether the fed printed products are arranged as a stack, a ply or an imbricate flow, before separation, they are transformed by a suitable mechanism into the mentioned standardized imbricate formation according to the principles of the present invention With folded printers' products, in contrast to the state of the art, the fold is preferably arranged at the top and the folded sheet is supported on its cut-edge side, so that the folded sheet may be grasped at the fold, either individually or in a defined number. The possible embodiments that may be constructed according to the principles of the present invention thus accordingly permit the processing of a column, a stack or other formations while using the same methods according to the principles of the present invention for separating the printed products, i.e. so that the products need not necessarily be fed as an imbricate flow. Where appropriate, thus the standing products e.g., of a column, are transferred into the desired obliquely lying position, whereas with an imbricate flow, as described above, an alignment of the printed products is required. Folded sheets, if required are sorted in advance so that they are directed with their cut-edge side orientated downward.

Embodiments of the invention shown here may have a modular construction and several modules may be interactively connected via standardized interfaces. A preferred form of an embodiment may use a take-over module, transfer module and a conveyor module arranged for removal of printed products. The take-over module serves for bringing the printed products which, where appropriate, are fed in a different form and arrangement of imbricate scaling, ply, pile, or stack, into a suitable, standardized initial position which is fed to the transfer module. The transfer module in particular serves for transforming the printed products by way of a guide according to the principles of the present invention, into an initial position which is optimal for the removal. Individual or a defined number of separated printed products may be removed and conveyed away by the subsequently arranged conveyor module. The conveyor module, for example, may be constructed as a revolving tension member or removal drum equipped with grippers.

In the transfer module the printed products are led actively or passively via a plane, that is a concavely or convexly curved or angularly bent guide surface of a guide. Connecting to the end region of the guide surface of the transfer module, there is arranged a conveyor which serves for removal or for separation and conveyance of the individual printed products. The printed products are led in an imbricate formation with the trailing edge positioned at the top, and are directed away by, onto the guide surface. A preferred embodiment form for a guide may use a guide surface with an end arranged to provide an essentially perpendicularly projecting edge which serves to facilitate controlled retention and alignment of the elements in the imbricate flow. In contrast to the devices known from the state of the art, an embodiment constructed according to the principles of the invention provides a device that permits a dynamic processing of the printed products. This implementation eliminates the basic change of direction which has a negative effect on the processing procedure as well as the processing speed. The elements are processed in a fluent manner and, above all, without a disadvantageous loading of the printed products, which means that in alignment and arrangement the printed products are transformed and separated in a gentle and continuous manner. Of course, embodiments of the invention may also include a passive removal, that is to say, the separation and isolation may be effected via the transfer module itself and the separated printed sheets or groups of printed sheets may be transferred to the removal unit which does not have a separating function.

Today's known functioning principles demand that the printed products be transferred while supported and practically lying in a flat manner. In contrast to this, the printed products with an embodiment constructed according to the principles of the present invention may be aligned by way of the guide so that in the transfer region of the guide surface, the printed products line up and are separated in an obliquely erect, and in a largely freely accessible position. In contrast to most solutions known from the state of the art, this furthermore has the advantage that the separating procedure does not necessitate a complete separation of each printed product before the separation of the next printed sheet. At the same time, with folded printed sheets, the fold is directed upwards, that is to say, away from the guide surface, so that the printed sheets may be grasped either individually or in a defined number by way of a gripper simply and with great accuracy. The printed products subjected to processing amongst one another and with the guide, display a favorable mutual influence and stabilization in the practice of this process, which is of particular relevance to the procedure in the end region of the guide sheet.

Several printing products bearing on one another, due to their specific properties and the arrangement, specifically their flexibility and mutual displacability, in their entirety, display an elastic and flexible behavior. A first form of elastic behavior may be observed with a bundle of printed products which is placed on a plane and is held by abutments and limitations. If the limitations of the printed product bundle in the longitudinal direction are pulled apart, the angle between the printed products and the plane becomes shallower. If the limitations of the bundle are however, pushed together, the angle between the plane and the printed products becomes steeper. Understood in this manner, the behavior of the printed products is elastic. A further form of elastic behavior in particular, may be observed with an arrangement of folded printed products. On account of the fold, the individual printed products tend to curve up or to open in regions. Also, with other flexible products or printed products such flexibility is attained on account of material unevenness and entrapment of air. This has the result that a corresponding stack or a corresponding ply of printed products may be elastically pressed together. A stack of folded newspaper sheets may, for example be considerably pressed together. It has been shown that in a guide according to the principles of the invention, given a suitable relative arrangement and alignment of the printed products to be aligned, this behavior may be used to achieve a compensation and buffering effect. This buffering effect, to a certain extent, acts as a dynamic intermediate storage (as a result of local compression) and geometric compensation on processing. This effect is used here in a targeted manner in order to compensate for differences in the processing speed between conveyance to and away, or to compensate for short-term malfunctioning.

So that the above-described effects may be exploited, the guide surface used in the guide preferably has a shape which leads to a compacting of the imbricate formation of printed products guided above it, and simultaneously leads to the printed products being erected, or inclined, in a controlled manner. Guide surfaces have a plane section which merges into an arc-shaped or straight section running obliquely downwards, are particularly suitable.

In order to separate the printed products, a limitation may be erected at the end of the guide surface, such as a mechanical abutment, which prevents farther travel of the printed products of the compacted imbricate flow along the guide surface. The printed products are dammed and aligned in a controlled manner in the active region of the mechanical abutment. Upon alignment into a vertical position, due to the shifting of the center of gravity of the printed products, the laterally acting force of gravity is continuously reduced so that the printed products come into an unstable equilibrium, and then have a tendency to flip over. At roughly this moment, the printed products come into the active region of the conveyer, which grips the printed products and leads them away individually. With alternative embodiments, there may be included a special separating device which transfers the printed sheets to a subsequent conveyor module.

In order to support the isolation of the printed products, in certain cases it is useful to provide a mechanism to actively change the inclination of the printed products in order to feed the printed products to the conveyor in a controlled manner at the moment at which the printed products tend to tip over. With this, it may be the case for example, of a rotating plane or structurized roller or a revolving cam belt, by way of which the printed products are influenced by friction, or by a positive or non-positive fit. According to the field of application, rollers equipped with either suction elements or wing compartment wheels which engage between the printed products and thus feed the printed products dynamically to the conveyor are also suitable. A controlled flow of air is likewise suitable because the flow acts on the printed products from the inside or from above. A further form for supporting this peeling-off or tipping procedure, here called folding-over or separation, may use a lever with one end attached to a suction cup. The lever is rotatably mounted about a pivot pin, wherein the fulcrum of the pivot pin is arranged on the region of the mechanical abutment at the end of the guide surface. The respective frontmost printed product which prevails at the mechanical abutment (e.g., brim), is pressed against the lever or suction cup. In order to transfer this first printed product then to the conveyor, the lever, and with it, the printed product held by the suction cup, is tilted in a relatively rapid manner so that the product is tilted relatively quickly and the printed product stands freely and may be grasped by the conveyor. The remaining printed products remain standing as a result of their inertia or, alternatively, they may be held by mechanical abutments. It is possible without further effort to also effect the removal or conveyance away with revolving roller pairs, conveyor belts or alternative conveyor means.

The distance between the guide surface and the conveyor, or the folding-over device, is preferably adjustable so that the device is suitable for processing printed products with a variable format. A further advantage of the invention lies in the fact that at the location of the separation, and when required, a points or switch system may be used so that the printed sheets may be transferred directly from the transfer module to various conveyors or may be removed.

The device, particularly on the guide surface, may be constructed with an additional active mechanism that serves to control the flow, the density and the shape of the imbricate flow. These guides, for example, with one or more revolving guiding belts such as, conveyor belts act by way of friction on the flow behavior and folding-over of the printed products. The guides may be arranged along the whole guide surface or alternatively, only in sections. According to requirement, the guides have either the same or different conveying speeds and are directed equally or counter to one another. The oblique position of the printed products is suitable in order to obtain a buffer and compensation effect, which, for example, serves to compensate for fluctuations in the processing speed.

In particular, a stabilizer may be incorporated into a region of the guide surface or of the guide that upon starting the device, or in the case of a disturbance, will stop or "freeze" the dynamic process. With these, it is the case preferably of a gripper, lever or flaps which when required engage the flow of printed products to be processed and support and stabilize the printed products in angle and alignment. These stabilizers may be arranged to be movable so that at least for a certain stretch, they may be concurrently moved with the flow of the printed products. Telescopically extendable flaps or rods are particularly suitable for starting and stopping the processing procedure. These stabilizers may form a part of the device or be arranged separately.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
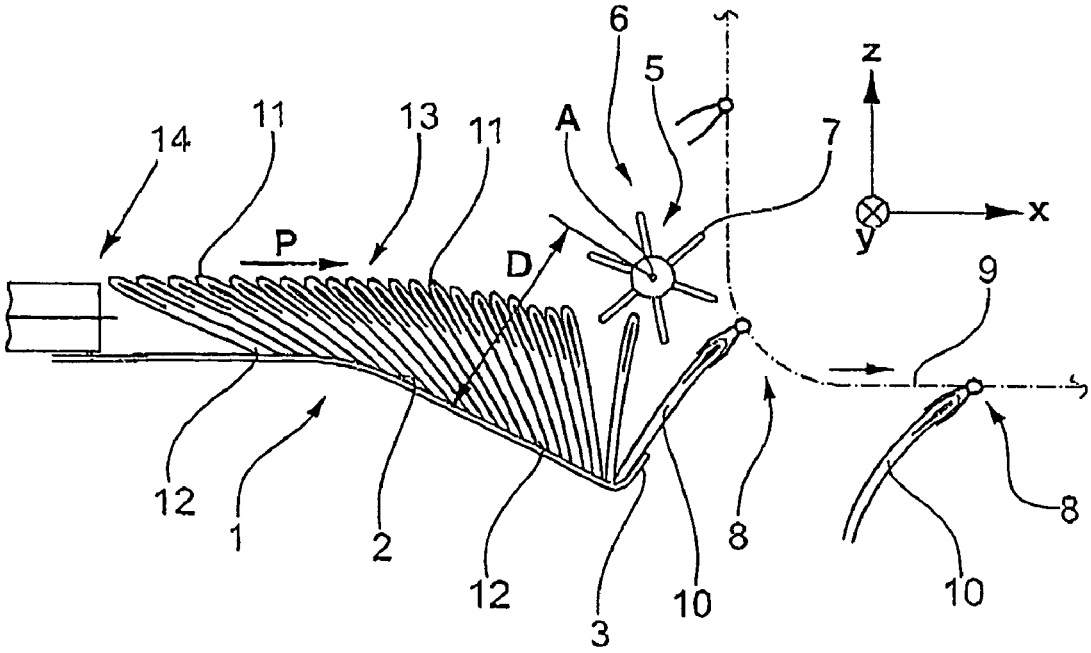
FIG. 1 is an elevational view that illustrates a first embodiment of a transfer device with a convex guide surface.

Turning now to the drawings, FIG. 1 shows in a lateral view, a first embodiment of a guide 1 constructed according to the principles of the present invention. On a convexly curved guide surface 2, printed products 10 are arranged in an imbricate formation 13 and are led in the direction of arrow P towards an edge or brim 3 which is arranged at the end of guide surface 2 and which serves as a mechanical abutment for printed products 10. Printed products 10 lie with their cut-edge side 12 on guide surface 2, wherein fold 11 of printed products 10 points upwards. Those printed products which are distanced farther from brim 3, are located in an imbricate arrangement with which fold 11 runs subsequent to (i.e., trails) the cut-edge side 12. Printed products 10 which are located nearer the brim 3, in contrast are steeper, that is, they are set standing obliquely and more closely to parallel. In contrast to the devices known from the state of the art, the transformation is effected in a fluent manner and is primarily effected by the interaction of the printed products amongst one another, and in particular, by the geometry of guide 1. With this, printed products 10 are fed to guide 1 by way of various designs of product feed 14 according to the state of the art shown only schematically here, e.g., a conveyor belt. Guide surface 2 may be constructed from sheet metal.

Printed products 10 are moved forward in the context of the imbricate formation 13 along guide surface 2 as a result of the effect of the force exerted by subsequent printed products and their inclination. Alternatively, or supplementary to this, an active device (which is not shown in more detail in this figure) may be added to guide 1, such as, by way of example, additional conveyor belts. Guide surface 2 and brim 3 influence the shape of the imbricate flow and the alignment of printed products 10 in a targeted manner and in a manner such that printed products 10 at the end of guide surface 2 in the region of brim 3 assume an optimal alignment for gripping, here by way of gripper 8 fastened upon a revolving tension element 9. Brim 3 dams the flow of imbricate formation 13, by which printed products 10 run onto one another in a controlled manner and are aligned as a result of the specific shape of guide surface 2. The curvature, and in particular the inclination of guide surface 2, are designed such that a controlled erection of printed products 10 is achieved. A further advantage of the curvature of guide surface 2 lies in the fact that the folded edges of the printed sheets, where appropriate with guide 1 engaging the folded side, may be made almost straight. This particularly simplifies the arrangement and design of the mechanism 5 for separating the printed sheets. According to the principles of this invention, guide surface 2 accordingly at least in some regions, is inclined with respect to the horizontal so that printed products 10 in the conveying direction are subjected to a certain wedge effect and thus "compression" of the product flow. This inclination of guide surface 2 in a preferred embodiment is inclined at least partly more than 30° . with respect to the horizontal so that the desired alignment of the printed products is effected. In the direct vicinity of brim 3, printed products 10 are located with the fold upward (that is, in z-direction) in an essentially perpendicular orientation from which either individually or in a defined number, printed products 10 are transferred to conveyor 9, here by grippers 8, for transfer elsewhere.

Above edge 3 folding-over mechanism 5 which serves to control folding-over of printed products 10. With the folding-over mechanism 5, it is the case here of a winged wheel 6 rotating about an axis A that is perpendicular to the plane of the drawing equipped with a plurality of radial, arms 7. The outwardly extending radial arms 7, as a result of the rotation of winged wheel 6, reach inwardly between printed products 10 located at the end of the guide surface and have the effect that the printed products thus engaged are released or peeled away in a controlled manner and are separated, or isolated, from one another in the region of the fold. Printed products 10 are separated from one another in the region of the fold 11 either individually or in a defined number, and are titled and brought into the active region of grippers 8, and are then gripped by one of the succession of grippers 8 and subsequently conveyed away from guide 2. It may be easily recognized in FIG. 1 that the folding-over effect a peeling away and subsequent "tipping-over" of the respective endmost printed product 10. According to the invention, the printed sheets on removal by way of folding-over mechanism 5 are actively transferred into an obliquely standing position in the direction of conveyor 9. Although the procedure described here effects an optimal removal, with other embodiments by way of folding-over mechanism 5 there may be effected a mere lifting for removal of printed products 10, so that the term "folding-over mechanism" is not to be understood in a limiting manner and this may also be understood as describing as a separating mechanism.

The distance D between the floor of guide surface 2 and the axis A of the axle of folding-over mechanism 5 or gripper 8 may be adjusted so that the embodiment may be used to process different sizes of elements. At the same time, the guide surface may be inclined differently or displaced, or alternatively, folding-over mechanism 5 and gripper 8 and conveyor 9 may also be arranged to be movable. With special embodiments, the adaptation to various formats may also be envisaged by sensors with suitable control and regulation which accordingly automatically adjust the control elements to regulate the position and forces of folding-over mechanism 5 and removal conveyor 5.

Figure 2:
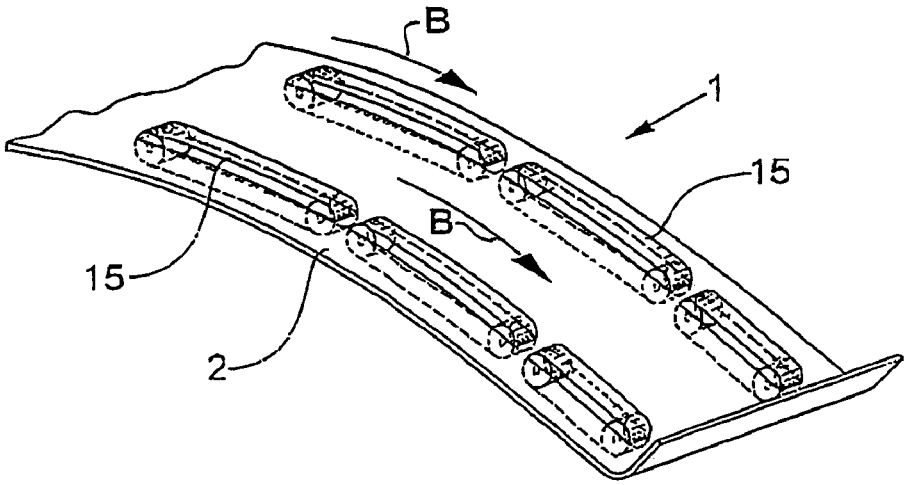
FIG. 2 is an oblique view that illustrates a second embodiment of a transfer device with conveyor belts.

FIG. 2 shows a lateral section of a second embodiment of a transfer device constructed with guide 1. Conveyor belts 15 are arranged along the guide surface parallel to the direction of flow B of an imbricate formation (not shown here), and serve as guiding elements, for the targeted acceleration or braking, in sections, of printed products 10 located on guide surface 2. The alignment and the flow behavior of die printed products are influenced in a targeted manner by way of this. According to the field of application, conveyor belts 15 are supported by air (e.g., either fanning-open by pressure or alternatively, retention by vacuum). Conveyor belts 15, when required, may furthermore be driven in the same or in opposite directions.

Guide 1, where appropriate, may be a changeable geometry, which at least in regions along guide surface 2 permits a targeted setting of the curvature of guide surface 2. Guide 1 may thus be adjusted to different printed products. By way of changing the curvature, one influences the inclination, but also friction forces and thus the flow and damming behavior. A preferred embodiment may be constructed with a guide manufactured of sheet metal, which is elastically deformed by a bending device, e.g., by way of an adjusting screw or hydraulics.

Figure 3:
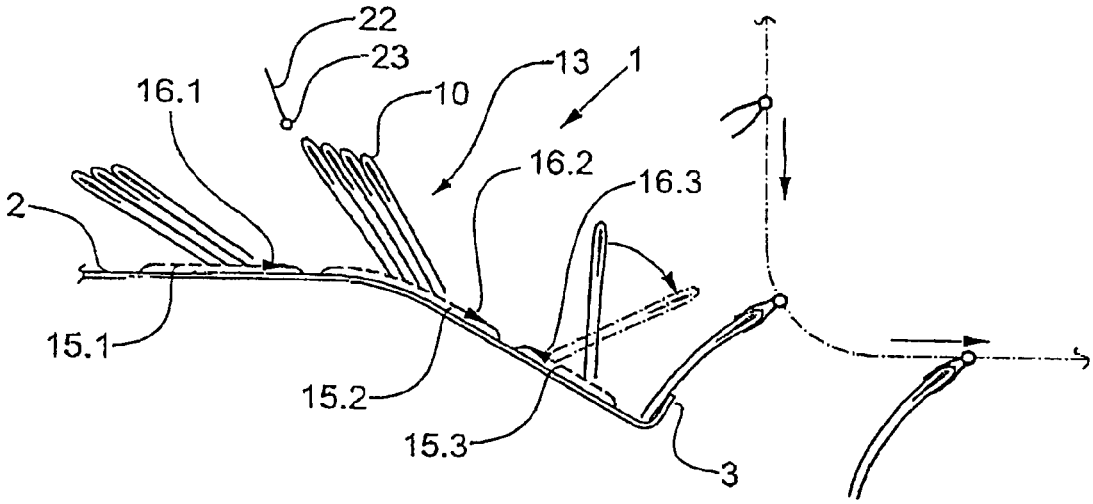
FIG. 3 is an elevational view that illustrates the embodiment of FIG. 2.

FIG. 3, by way of arrows 16.1, 16.2, 16.3, schematically shows the influence of three conveyor belts 15.1, 15.2, 15.3, on printed products 10 of imbricate formation 13. The length of the arrows 16.1, 16.2, 16.3, by way of example, illustrate the speed of conveyor belts 15. As the arrows 16.1, 16.2 illustrate the conveyor belts 15.1, 15.2, 15.3 here are driven in the flow direction of imbricate formation 13, wherein second conveyor belt 15.2 has a higher speed 16.2 than the two other conveyor belts 15.1 and 15.3. By way of this, it is achieved that printed products 10 in this region are accelerated at the cut-edge side in the direction of brim 3. After printed products 10 have left the active region of second conveyor belt 15.2, they get into the active region of third conveyor belt 15.3 where the printed product are braked at their cut-edge side. By way of this procedure, it is achieved that the printed products 10 are erected in a controlled manner. Other embodiment forms and drive concepts are also possible according to requirement. The conveyor belts 15 may be driven differently or regulated or controlled and different friction forces with respect to the conveyor belts 15 or guide sheet 2 may additionally influence the product flow.

The conveyor belts 15.1, 15.2, and 15.3 furthermore serve the control of the arrangement of the printed products, in particular on starting and stopping the device and in the case of malfunctioning. Erecting or pivotable flaps and grippers, here indicated by a flap 22 pivotable about an axis 23, in a supplementary manner or alternatively serve as a control and stabilizing means for the position and alignment of the printed products. When required, these means may be designed movable, and led subsequently to the product flow.

Figure 4:
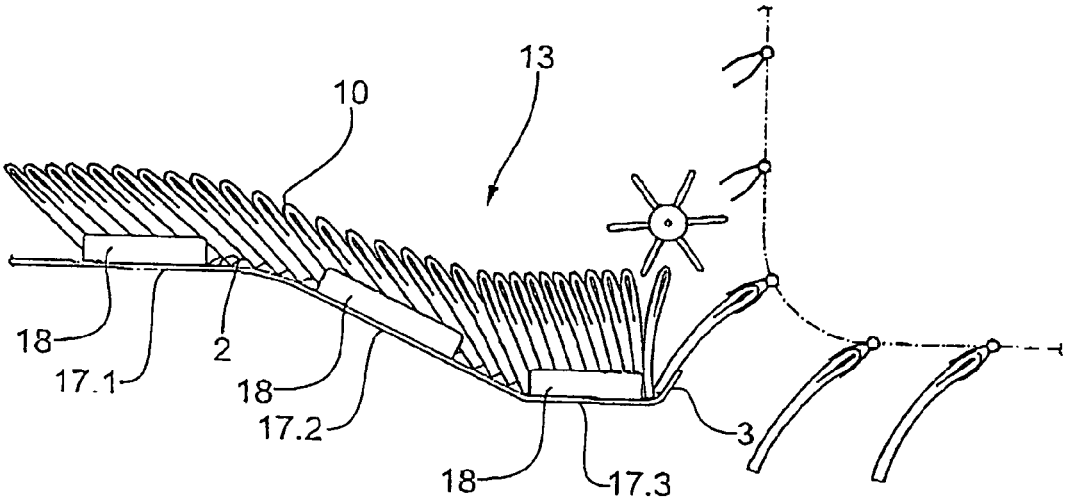
FIG. 4 is an elevational view that illustrates a third embodiment of a transfer device constructed with essentially straight sections.

These conveyor belts 15.1 to 15.3 support the procedure already described by way of FIG. 1, with which the printed products 10 on supply to the guide surface 2 of the guide means 1 are conveyed lying in an overlapping manner, wherein the trailing edge of a printed product in each case lies over the leading edge of the subsequent printed product. During the transport over the guide surface 2, the printed sheets 10 are continuously erected so that on removal from the guide means 1 they have an obliquely standing position, with which the printed products are inclined slightly opposite to the conveying direction, FIG. 4 shows a third embodiment form of a guide surface 2. This is composed of three essentially straight sections 17.1, 17.2, 17.3. Due to the greater inclination of the second section, it is effected that the printed products 10 increasingly dam in the third section 17.3 and here are erected in a controlled manner. Due to the length of the guide surface or its inclination and surface nature the compacting of the imbricate formation 13 in the transfer region of the brim 3 is set. The shape of the guide surface 2 is to be determined depending on the nature of the printed products to be processed. On the guide surface 2 there are present additional guide elements 18 which stabilize and lead the flow of tile printed products 10 in the lateral direction. With the guide element 18, it is the case preferably of projecting guide sheet [metal] which is arranged essentially parallel to the flow direction of the imbricate flow. These guide elements 18 are preferably arranged in an adjustable manner so that they may be set to the width of the printed products 10. The guide elements 18 serve for stabilization of the dynamic flow of the imbricate formation 13. In order to achieve an additional stabilization on standstill of the formation 13, i.e., if the printed products 10 are not in motion, the guide means may be moved toward one another so that the printed products 10 are clamped therebetween and thus are stabilized. Additional elements, e.g., in the form of laterally engaging pins are conceivable.

A further embodiment form with guide means 18 uses laterally arranged conveyor means. With this, it is preferably the case of conveyor belts, conveyor rollers, vacuum belts or brush conveyors. The guide means 18 this time are not arranged in the proximity of the guide surface as shown in the example, but may be arranged also at a constant or variable height next to the guide surface 2.

Figure 5:
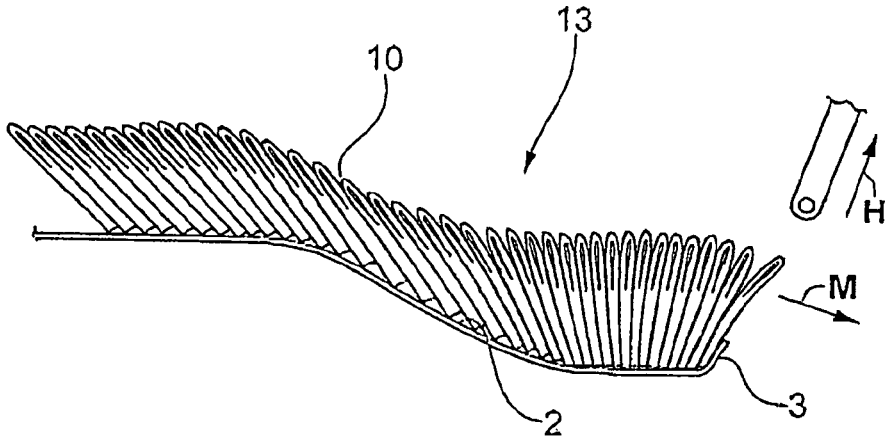
FIG. 5 is an elevational view that illustrates a fourth embodiment of a transfer device constructed with a convex guide surface.

FIG. 5 shows an essentially concavely shaped guide surface. 2. The compacting of the printed products located in the region of the brim 3 here differs from the other shown embodiment forms. It may be recognized that due to the geometry of the guide surface 2 and the relatively few supplied printed products, the imbricate formation has a comparatively loose arrangement. The edge 3 is inclined away in the direction of the product flow, so that the frontmost printed sheet has an inclination which is directed to the right, and forms a support for the subsequent printed sheet.

As is to be recognized, the printed products 10 are not subjected to abrupt changes in direction, but rather, are constantly and continuously brought into a position which is optimal for isolation and gripping. Byway of an arrangement with which the fold is arranged upward, the printed products may be simply gripped. The guide surfaces are preferably formed by the surfaces of a suitably formed sheet [metal]. The concept based on the flow behaviour and the specific properties of an imbricate flow permits a simple and robust construction. Since one practically requires no quickly moved parts and the printed products are not subjected to an abrupt direction change or mechanical loading, devices according to the invention permit comparatively higher processing speeds. An additional advantage of the invention is manifested in that in particular with folded sheets in the region of the cut-edge side, there arises a greater compression than in the middle or on the fold edge of the folded sheet. The folded sheets have the tendency to extend in the middle region so that the fold edges do not bear tightly on one another, but may be processed in a slightly fanned-open formation, which in particular simplifies the separation or the already described folding-over.

The above described embodiment examples have a brim 3 which is directly connected to the guide means. The required abutment however, according to the invention, may also be formed by way of a separate means, for example, a movable sheet [metal] or abutment rods. In this case it is possible to design the abutment in an adjustable manner so that with different product properties (size, flexibility, thickness, etc.) one provides an adjusting possibility, In FIG. 5 there is indicated a movable abutment which on removal of a printed sheet is moved in the direction of the arrow M so that the frontmost printed product may also be released on the cut-edge side and thus may be easily removed. The removal means in the embodiment example according to FIG. 5 comprises a conveyor with which the printed products directly after separation (here not shown in detail) and the removal are conveyed away essentially vertically upward in the direction of arrow H.

With particular embodiment forms the brim 3 or the abutment may also be formed by movable elements which convey the printed products in the removal direction so that the removal procedure may be supported in such a manner. With this, a person skilled in the art would provide rollers revolving about a horizontal axis, where appropriate controllable, which minimize and avoid any frinction forces of the products to be removed with respect to the brim 3. With particular embodiment forms, with the separation, one may also directly effect a transfer to various removal means, e,g., to various grippers in an alternating manner.

Figure 6:
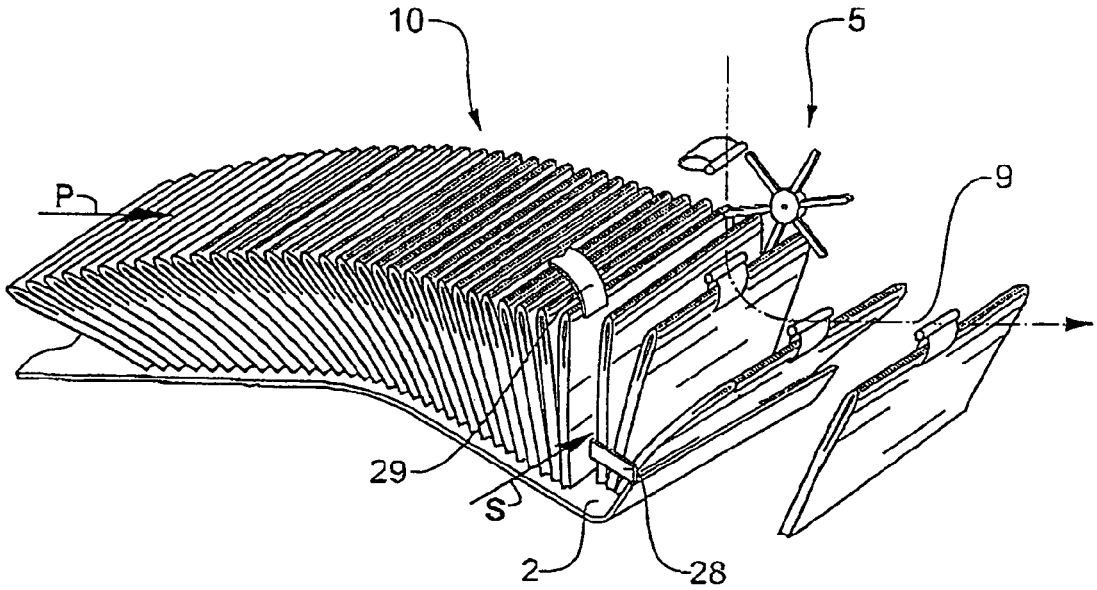
FIG. 6 is an oblique view that illustrates a further embodiment constructed to provide a transverse displacement of the printed sheets directly before removal.

In FIG. 6 there is shown an alternative embodiment example of the invention. Here the printed products, directly before the separation and removal, are slightly displaced in the direction of arrow S with respect to their main conveying direction P essentially at right angles on the guide surface 2. This transverse shifting may be effected by a simple lift means, for example, a sheet [metal] plating which engages at the side edges of the printed products. Furthermore, the subsequent printed products may be held back in a simple manner by way of a retaining means 29 on the fold side. After separation, the printed products are conveyed away by way of the removal means 9 in the manner described above.

What is claims is:

1. A method for processing and separating flexible, flat objects during product feed, comprised of:

continuously feeding flexible objects to a transfer module in an essentially regular imbricate formation as the flexible objects fluently advance along a guide within said transfer module with leading lower edges of the flexible objects supported on a surface of the guide and with a trailing edge of each flexible object lying over the leading lower edge of a subsequent flexible object;

erecting the flexible objects during said product feed along the guide into obliquely standing positions with leading upper edges of the flexible objects exhibiting inclinations opposite to orientations of the flexible objects when initially fed along the guide; and accommodating separation of the flexible objects from the obliquely standing positions with leading upper edges of the flexible objects exhibiting inclinations opposite to orientations of the flexible objects when erecting the flexible objects during said product feed along the guide, in a defined number from the flexible objects remaining supported by the guide;

conveying the flexible objects away from the transfer module using a gripper to select a single flexible object or a predetermined number of flexible objects, wherein the erecting step is performed by first accelerating the speed of the flexible objects through the guide and then decelerating the speed of the flexible objects further along the guide.

2. The method according to claim 1, comprised of the flexible objects, during said advance of the flexible objects over the surface of the guide, being continuously rotated to the orientations of the flexible objects in said obliquely standing position and inclined in an opposite orientation when initially fed along the guide path.

3. The method according to claim 1, wherein the flexible objects are folded sheets, whereby a fold of each folded sheet lies in a trailing manner over a respective subsequent folded sheet and the folded sheets obliquely standing at said conveyance away from the guide stand on cut-edge sides.

4. The method according to claim 2, wherein the flexible objects are folded sheets, wherein the fold of each folded sheet in a trailing manner lies over the respective subsequent folded sheet and the folded sheets which stand obliquely on separation from the guide stand on corresponding cut-edge sides of the folded sheets.

5. The method according to claim 1, wherein the erecting of the flexible objects is effected by active braking or acceleration of the flexible objects along at least one edge by independently driving each of a plurality of conveying elements disposed upon the guide.

6. The method according to claim 1, comprised of contributing to said erecting of said flexible objects by sequentially urging upper edges of the flexible objects in a direction of said advance.

7. The method according to claim 1, comprised of contributing to said erecting of said flexible objects by individually regulating movement of a plurality of conveyors disposed along said guide to movingly engage the lower edges.

8. The method according to claim 1, comprised of contributing to said erecting of said flexible objects by terminating said guide with an abutment oriented outwardly from said guide in a direction of said advance.

* * * * *